US008033860B2

(12) United States Patent
Milstein et al.

(10) Patent No.: US 8,033,860 B2
(45) Date of Patent: Oct. 11, 2011

(54) STACK ABLE PATCH CABLE FOR SPLITTING AN ELECTRICAL SIGNAL

(76) Inventors: Gur Yitzhak Milstein, Los Angeles, CA (US); Duy Le, Santa Monica, CA (US)

( * ) Notice: Subject to any disclaimer, the term of this patent is extended or adjusted under 35 U.S.C. 154(b) by 0 days.

(21) Appl. No.: 12/648,208

(22) Filed: Dec. 28, 2009

(65) Prior Publication Data

US 2010/0173525 A1 Jul. 8, 2010

Related U.S. Application Data

(60) Provisional application No. 61/203,988, filed on Jan. 2, 2009.

(51) Int. Cl.
*H01R 11/00* (2006.01)

(52) U.S. Cl. ..... 439/502; 439/587

(58) Field of Classification Search ..... 439/502, 439/587

See application file for complete search history.

(56) References Cited

U.S. PATENT DOCUMENTS 3,927,353 A * 12/1975 Reid et al. ..... 361/104
4,364,625 A 12/1982 Baker et al.
4,920,233 A 4/1990 Kincaid
5,362,251 A * 11/1994 Bielak ..... 439/394
6,250,963 B1 * 6/2001 Wright ..... 439/589
6,350,150 B2 * 2/2002 DeLadurantaye, III ..... 439/502
6,442,325 B1 * 8/2002 Everett et al. ..... 385/147
6,623,295 B2 * 9/2003 DeLadurantaye, III ..... 439/502
7,758,365 B2 * 7/2010 Purchon ..... 439/188

* cited by examiner

*Primary Examiner* — Truc Nguyen
(74) *Attorney, Agent, or Firm* — Risso & Associates; Marcus Risso

(57) ABSTRACT

A stack able patch cable for splitting an electrical signal is described. The patch cable includes two plug members connected via a cable. Each plug member includes a male end and a female end. The male end has a male signal contact and a male shield contact electrically isolated from the male signal contact. The female end includes a female signal contact and a female shield contact electrically isolated from the female signal contact. Additionally, the female signal contact is electrically connected with the male signal contact and the female shield contact is electrically connected with the male shield contact. Further, the female end is configured to receive a male end of a plug to electrically connect the corresponding contacts. Thus, the plug member is capable of receiving and connecting directly with another plug member to split a signal while maintaining signal quality.

14 Claims, 7 Drawing Sheets

STACK ABLE PATCH CABLE FOR SPLITTING AN ELECTRICAL SIGNAL

PRIORITY CLAIM

This is a Non-Provisional Utility Patent Application of U.S. Provisional Application No. 61/203,988, filed on Jan. 2, 2009, entitled, "Stack able audio cable."

BACKGROUND OF THE INVENTION (1) Field of Invention

The present invention relates to a patch cable and, more particularly to a stack able audio cable for splitting an audio signal.

(2) Description of Related Art

Audio cables have long been known in the art for sending and sharing audio signals. Shielded audio cables and connectors had been the main choice of connectivity for audio signals. Such common cables are the shielded ¼ inch and ⅛ inch phone plugs, as well as their metric equivalents. These cables are widely used for connectivity in audio equipment, such as guitars, audio synthesizers, and pro-audio recording and broadcasting equipment. The electrical shield found in these cables acts as Faraday cage to reduce external electrical noise that might be affecting the audio signal. The electrical shield also reduces the emission of electromagnetic radiation that might be generated by the signal to prevent it from interfering with nearby electrical devices. The inner conductor usually carries the audio signal while the shield conductor is tied to an electrical reference voltage, typically ground (GND). Additionally, the shielded plugs and jacks enable the common GND of separately powered electrical devices to be shared through the shielded GND.

In sending an audio signal, it is often desirable to split the signal. In order to carry a signal from one point to several points (or vice versa), splitters, multipliers or patch bays are required. A problem with such splitters, multipliers, and patch bays is that they are often large, cumbersome, and expensive items. Importantly, when splitting the signal using traditional devices, the signal enters the splitter, etc., and leaves the protection of the Faraday cage. By leaving the Faraday cage, the signal is exposed to a non-shielded environment, which then subjects it to many of the aforementioned problems. As such, traditional devices for splitting an audio signal can often result signal interference.

Thus, a continuing need exists for a simple audio cable that allows a user to split the audio signal while maintaining the signal fidelity as provided by the Faraday cage.

SUMMARY OF INVENTION

While considering the failure of others to make use of all of the above factors/ingredients/steps/components in this technology space, the inventor unexpectedly realized that a stack able patch cable can be used to split an audio signal while maintaining a shielded environment.

The stack able patch cable includes a first plug member connected with a second plug member via a cable. The first plug member having a male end and female end. The male end includes a male signal contact and a male shield contact electrically isolated from the male signal contact. Alternatively, the female end includes a female signal contact and a female shield contact electrically isolated from the female signal contact. To enable signal splitting, the female signal contact is electrically connected with the male signal contact. Further, to protect signal fidelity, the female shield contact is electrically connected with the male shield contact. Finally, the female end is configured to receive a male end of a plug to electrically connect the corresponding contacts.

With respect to the cable, the cable has a first end and a second end. The first end of the cable is connected with and extends from the first plug member. The cable includes a relatively flexible, elongate core conductor disposed at the center of the cable. The core conductor is electrically connected with both the male and female signal contacts. A first sleeve of an insulating material is positioned about the core conductor. To protect the signal from outside interference, a relatively flexible shield conductor is disposed outwardly of the first sleeve. The shield conductor is electrically connected with both the male and female shield contacts. Further, a second sleeve of an insulating material is positioned about the shield conductor.

As noted above, the present invention also includes a second plug member. The second plug member is connected with the second end of the cable and has both a male end and a female end. The male end includes a male signal contact and a male shield contact that is electrically isolated from the male signal contact. The female end includes a female signal contact and a female shield contact that is electrically isolated from the female signal contact. As was the case above, the female signal contact is electrically connected with the male signal contact and the female shield contact is electrically connected with the male shield contact. Again, the female end is configured to receive a male end of a plug to electrically connect the corresponding contacts.

In another aspect, the shield conductor is formed of a metallic braid that is braided around the first sleeve of insulating material.

In yet another aspect, within each plug member, a shared central axis runs through approximately a center of the female end and the corresponding male end, thereby allowing a plurality of plugs to be connected with one another in a stacked configuration with the plurality of plugs sharing the shared central axis.

Additionally, within each plug member, the male end is formed as an elongated post, with the signal contact being formed as a central post and the shield contact being formed as a ring that partially surrounds the central post.

In yet another aspect, within each plug member, the female end is formed as a receptacle, with the female signal contact formed as a clip for mating with the elongated post, and wherein the female shield contact is formed as a metallic sleeve for mating with the ring.

Finally, as can be appreciated by one in the art, the present invention also comprises a method for forming the stack able patch cable described herein. The method includes a plurality of acts of forming and connected the various components of the patch cable.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figures 1A, 1B:
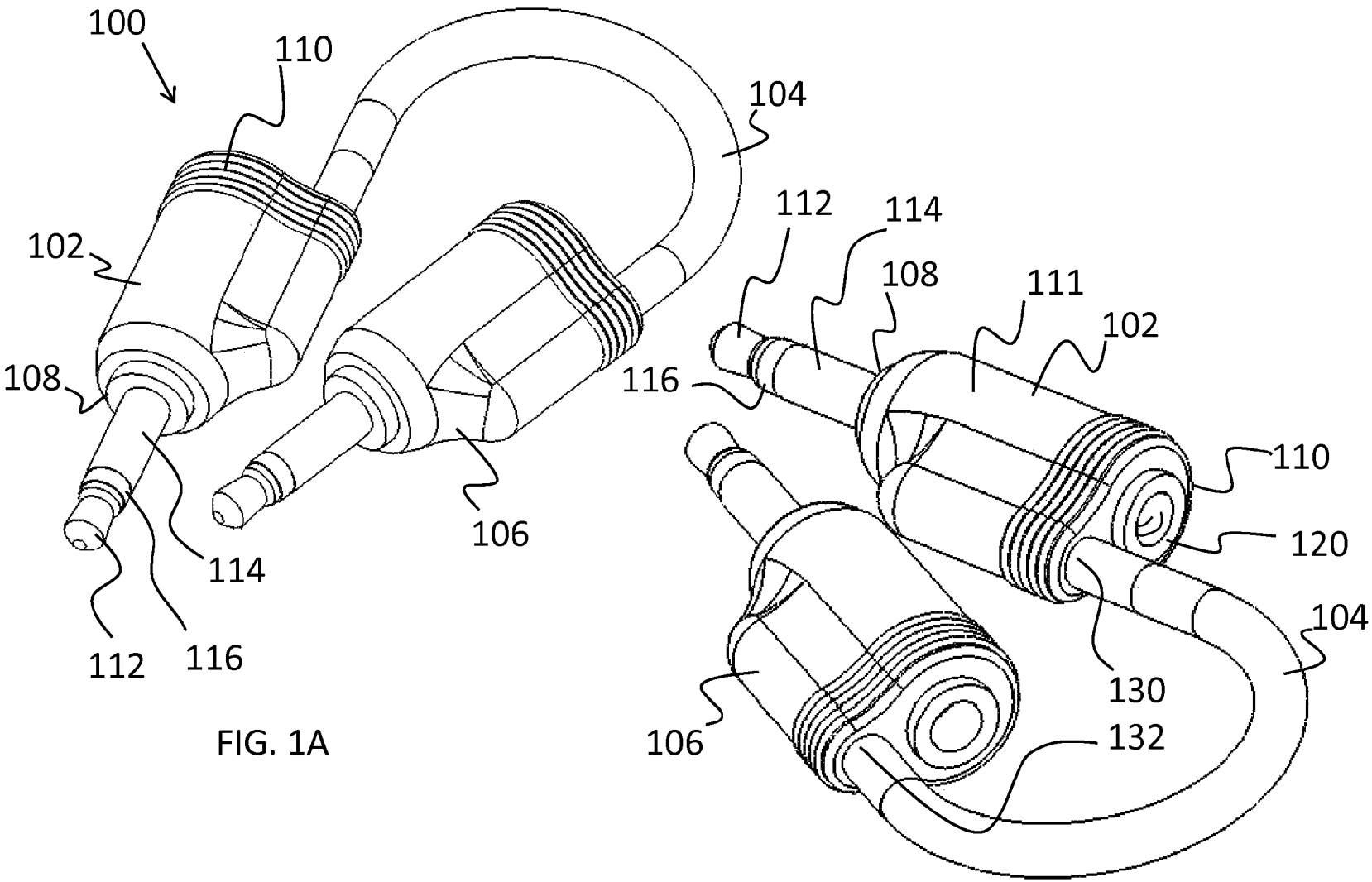
FIG. 1A is a perspective-view illustration of a stack able patch cable according to the present invention.
FIG. 1B is a perspective-view illustration of the stack able patch cable.
Figure 2D:
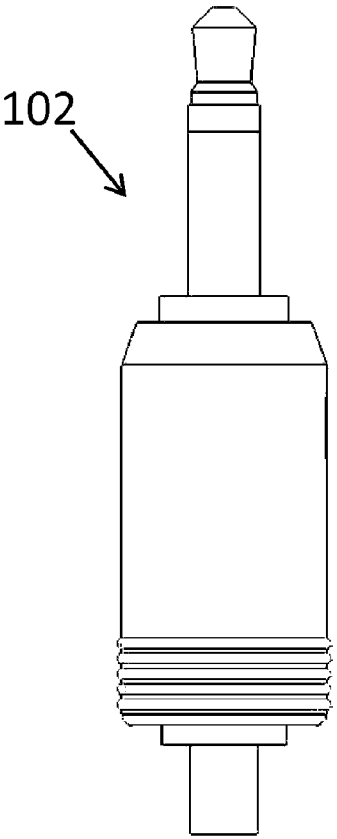
FIG. 2D is a left, orthogonal-view illustration of the plug member.
Figure 2C:
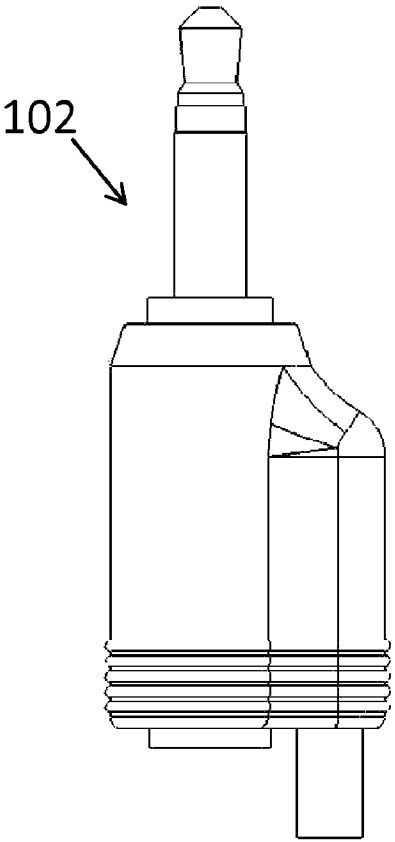
FIG. 2C is a back, orthogonal-view illustration of the plug member.
Figure 2B:
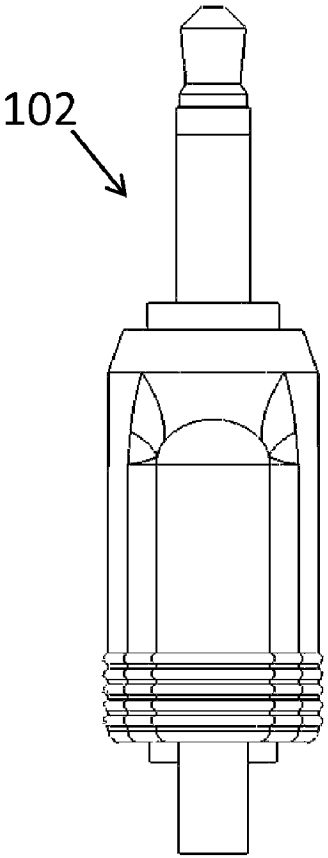
FIG. 2B is a right, orthogonal-view illustration of the plug member.
Figure 2A:
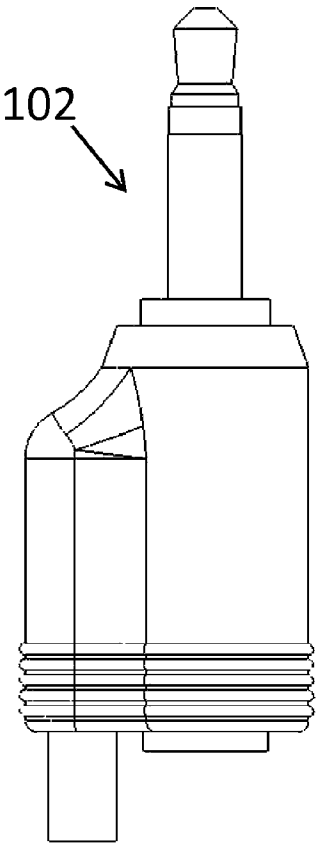
FIG. 2A is a front, orthogonal-view illustration of a plug member according to the present invention.

The present invention relates to a patch cable and, more particularly to a stack able audio cable for splitting an audio signal. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Introduction

As noted above, the present invention is a stack able patch cable for splitting an electrical signal, such as an audio signal. More specifically, the present invention is a shielded cable assembly called the Stack Able Audio Cable (SAAC). It should be understood that the terms "stack able patch cable" and "SAAC" refer to the same thing and can be used interchangeably herein. The SAAC utilizes a shielded cable with a shielded plug/jack combination on one end or both ends of the cable. Each end provides a shielded stereo, mono or multi-conductor plug with a stereo, mono or multi-conductor jack at its back with, or without, additional passive or active electronic parts. The SAAC enables a user to stack up to N amount of jacks to split and or combine audio signals. The SAAC also enables a user to cascade cables, acting as an extension cable to patch up longer patch cables where needed.

The present invention enables the distribution of audio signals without the need for additional splitters and multiplies. Thus, the present invention provides a benefit of simple and fast signal connectivity while maintaining the signal quality. As can be appreciated by one skilled in the art, there are many uses where such a device is beneficial.

As a non-limiting example, a guitar player can use the SAAC to easily split a signal from the guitar to several other devices (e.g., pre-amps, etc.). As yet another example, an audio synthesizer can use the SAAC to patch various synthesizing modules together in a variety of combinations. Further, a sound engineer can use the SAAC to quickly split and distribute an audio signal around a studio while reducing the length of cables and mechanical connectors that are typically used for such splitting and distribution (thereby reducing the loss in signal strength and quality).

It should be noted that all the benefits described above are achieved without compromising electrical shielding properties (i.e., for protecting the audio signal). The SAAC keeps the signal in a shielded Faraday cage from the moment the signal leaves its origin and to the many destinations without being exposed to a non shielded environment (such as in the case of patch bays, splitters or multiplies). Thus, the SAAC structure is extremely well suited to protect the audio signal from cross talk, a common problem in the audio recording and broadcasting industry.

It should be noted that although the present invention is described as being used for audio purposes, other types of electrical signals can also be facilitated using the present invention, a non-limiting example of which includes a video signal. Thus, although the SAAC has been developed mainly for audio use, other type of electrical signals will enjoy some or all of the benefits as listed above. As such, the SAAC is a multi-purpose electrical patch cable.

(2) Specific Details

As noted above, the present invention is a stack able patch cable (i.e., Stack Able Audio Cable (SAAC)) for splitting an electrical signal (such as an audio signal). As shown in FIGS. 1A and 1B, the stack able patch cable 100 includes a first plug member 102, a cable 104, and a second plug member 106.

The first plug member 102 includes a male end 108 and a female end 110, with a housing 111 that captures both ends. The housing 111 is formed of a non-conductive material to maintain the various components with respect to one another and prevent signal jumping therebetween. The male end 108 includes a male signal contact 112 and a male shield contact 114 that is electrically isolated from the male signal contact 112. Each of the contacts is formed of an electrically conductive material, a non-limiting example of which includes a conductive metal. The signal contact 112 and shield contact 114 are electrically isolated from one another using a non-conductive barrier 116, a non-limiting example of which includes plastic.

Alternatively, the female end 110 includes a female signal contact (described in further detail below) and a female shield contact 120. Again, the shield contact 120 is electrically isolated from the female signal contact using a suitable non-conductive barrier.

As depicted, the cable 104 has a first end 130 and a second end 132. The first plug member 102 is connected with the first end 130 of the cable 104, while the second plug member 106 is connected with the second end 132 of the cable 104. Although the present invention is depicted as having both a first and second plug member 102 and 104, respectively, the invention is not intended to be limited thereto. As can be appreciated by one skilled in the art, the cable 100 can be attached with a first plug member 102 on the first end 130 of the cable 104, and any type of plug, mechanism, or device on the second 132 of the cable 104, including an open-ended cable. Alternatively, the invention can be formed such that there are multiple cables extending from a single plug member.

Further, the female end 110 is formed to receive a male end 108, thereby allowing a user to stack the cables. To provide for signal splitting, the female signal contact is electrically connected with the male signal contact. Alternatively, the female shield contact is electrically connected with the male shield contact. Thus, by plugging a male end 108 into a female end 110, the corresponding signal and shield contacts are electrically connected, which allows a user to split the signal.

It should also be understood that the second plug member 106 has similar components to that of the first plug member 102. As such, the components as described with respect to the first plug member 102 are duplicated in and equally applicable to the second plug member 106. Thus, it should be understood that any reference to components in the first plug member 102 can be equally applied to the second plug member 106, and any subsequent plug member.

FIGS. 2A through 2D illustrate the first plug member 102, depicting front, right, back, and left orthogonal views, respectively.

Figure 3B:
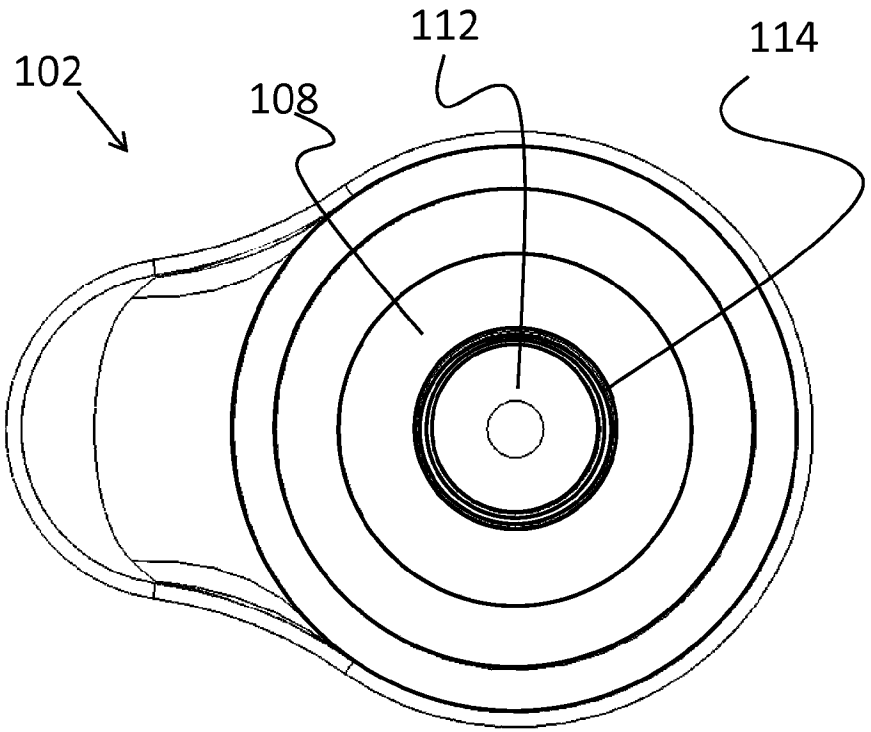
FIG. 3B is a top, orthogonal-view illustration of the plug member.
Figure 3A:
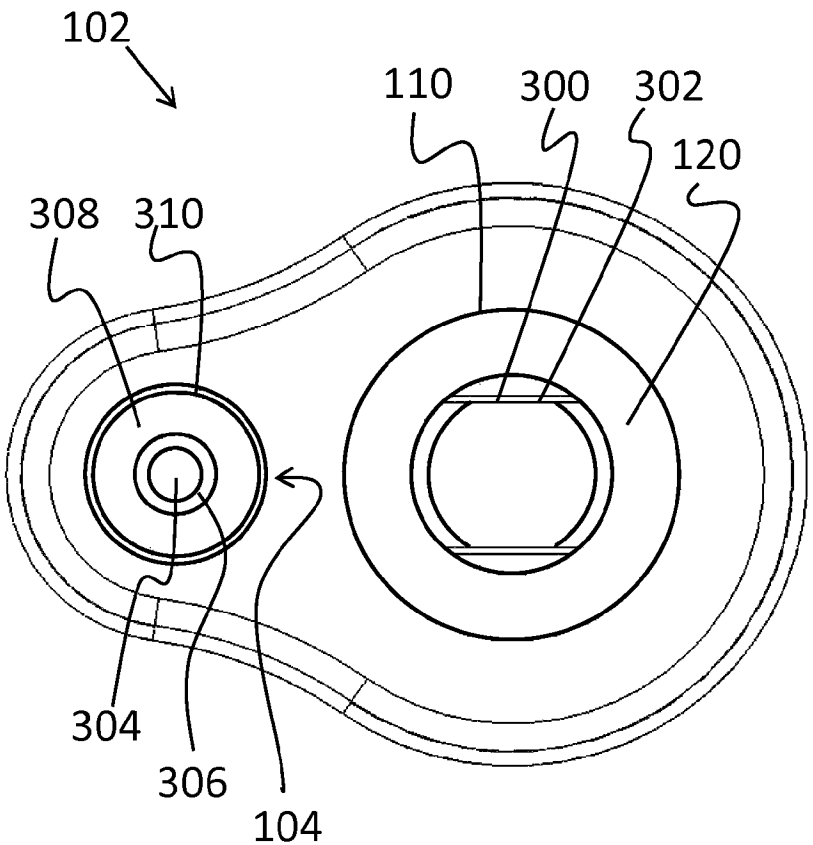
FIG. 3A is a bottom, orthogonal-view illustration of the plug member.

FIGS. 3A and 3B illustrate the first plug member 102, depicting bottom orthogonal and top orthogonal views, respectively. As shown in FIG. 3A, the female end 110 includes a female signal contact 300 and the female shield contact 120. Alternatively, FIG. 3B illustrates the male end 108, along with the male signal contact 112 and male shield contact 114. As can be appreciated by one skilled in the art, the female end 110 is formed as a receptacle, with the female signal contact 300 formed as a clip 302 for mating with the male signal contact 112, whereas the female shield contact 120 is formed as a metallic sleeve for mating with the corresponding male shield contact 114. Although the female signal contact 300 is described as having a clip 302, the clip 302 is only the portion of the contact that affixes the male signal contact 112 (of another plug member) therein. Further, it should be understood that there are several techniques for affixing the male signal contact 112 with the female signal contact 300 and that the clip 302 is but one non-limiting example.

As described above, a cable 104 is affixed with each of the plug members. FIG. 3A depicts a cross-sectional view of the cable 104. The cable 104 is any suitable cable for carrying a signal from one location to another. As a non-limiting example, the cable includes a relatively flexible, elongate core conductor 304 that is disposed at the center of the cable 104. The core conductor 304 is formed of a suitably conductive material, a non-limiting example of which includes metallic wire. The core conductor 304 is electrically connected with both the male and female signal contacts 112 and 300, respectively. To protect the signal, a first sleeve 306 of insulating material is positioned about the core conductor 304. The first sleeve 306 is formed of any suitably non-conductive material. For example, the first sleeve 306 of insulating material is a plastic sheath (or any other suitably non-conductive material) that is wrapped around the core conductor 304.

To shield the signal, a relatively flexible shield conductor 308 is disposed outwardly of the first sleeve 306. The shield conductor 308 is formed of any suitably conductive material, a non-limiting example of which includes metallic wire or braid that is braided around the first sleeve 306. The shield conductor 306 is electrically connected with both the male and female shield contacts, 114 and 120, respectively. By sharing the common ground through the shield contacts 114 and 120 and the shield conductor 308, the signal is effectively maintained in the Faraday cage (which uses the shield contacts and shield conductors to surround the signal contacts and core conductor).

Finally, a second sleeve 310 of an insulating material is positioned about the shield conductor 308. As was the case above, the second sleeve 310 of insulating material is a plastic sheath (or any other suitably non-conductive material) that is wrapped around the core conductor shield conductor 308.

Figure 4:
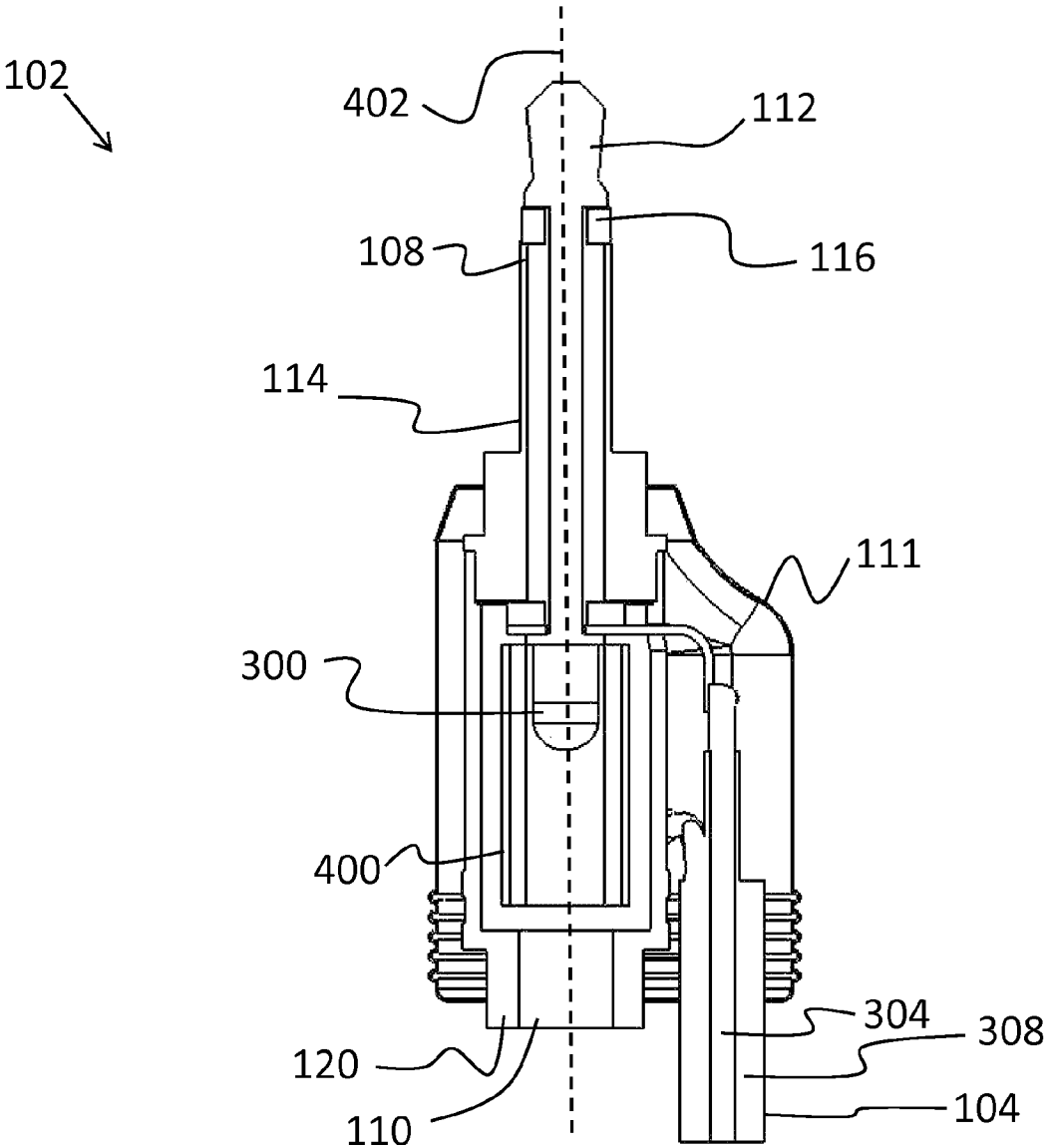
FIG. 4 is a left, cross-sectional view illustration the plug member.

For further understanding, FIG. 4 provides a cross-sectional view of the first plug member 102. As shown, the male signal contact 112 is electrically connected with the female signal contact 300. Additionally, the male shield contact 114 is electrically connected with the female shield contact 120. Also depicted is the male end barrier 116 that electrically isolates the male signal contact 112 from the male shield contact 114, and the corresponding female end barrier 400 that electrically isolates the female signal contact 300 from the female shield contact 120. The cable 104 is shown as entering the housing 111, with the core conductor 304 being electrically connected with the signal contacts 112 and 300, while the shield conductor 308 is electrically connected with the shield contacts 114 and 120.

As shown in FIG. 4, within each plug member, the male end 108 is formed as an elongated post, with the male signal contact 112 being formed as a central post and the male shield contact 114 being formed as a ring or sheath that wraps around and partially surrounds the central post.

As depicted in FIG. 4 and throughout the drawings, the shield contacts surround or partially surround the signal contacts throughout the device to protect the signal fidelity via creation of the Faraday cage.

FIG. 4 also depicts that within each plug member, a shared central axis 402 runs through approximately a center of the female end 110 and the corresponding male end 108. Thus, due to the shared central axis 402, a plurality of plugs can be connected with one another in a stacked configuration, with the plurality of plugs sharing the shared central axis 402. It should be understood that although the present invention is depicted as having a male end 108 and female end 110 as sharing a central axis 402, the present invention is not intended to be limited thereto as there are other configurations that can be employed and still include a plug member that has both a male and female end 108 and 110. For example, the ends can be positioned side-by-side, or at various angles.

It should also be understood that although the drawings are directed to a mono configuration, the present invention can be used in a stereo setup, where both multiple male ends and female ends protrude from the housing. Each of the male ends would be assigned a corresponding female end, through which they would have electrically connected signal contacts. However, each signal contact is electrically isolated across male ends (and corresponding female ends). Further, to enhance shielding, all of the ends would share electrically connected shield contacts.

Figure 5:
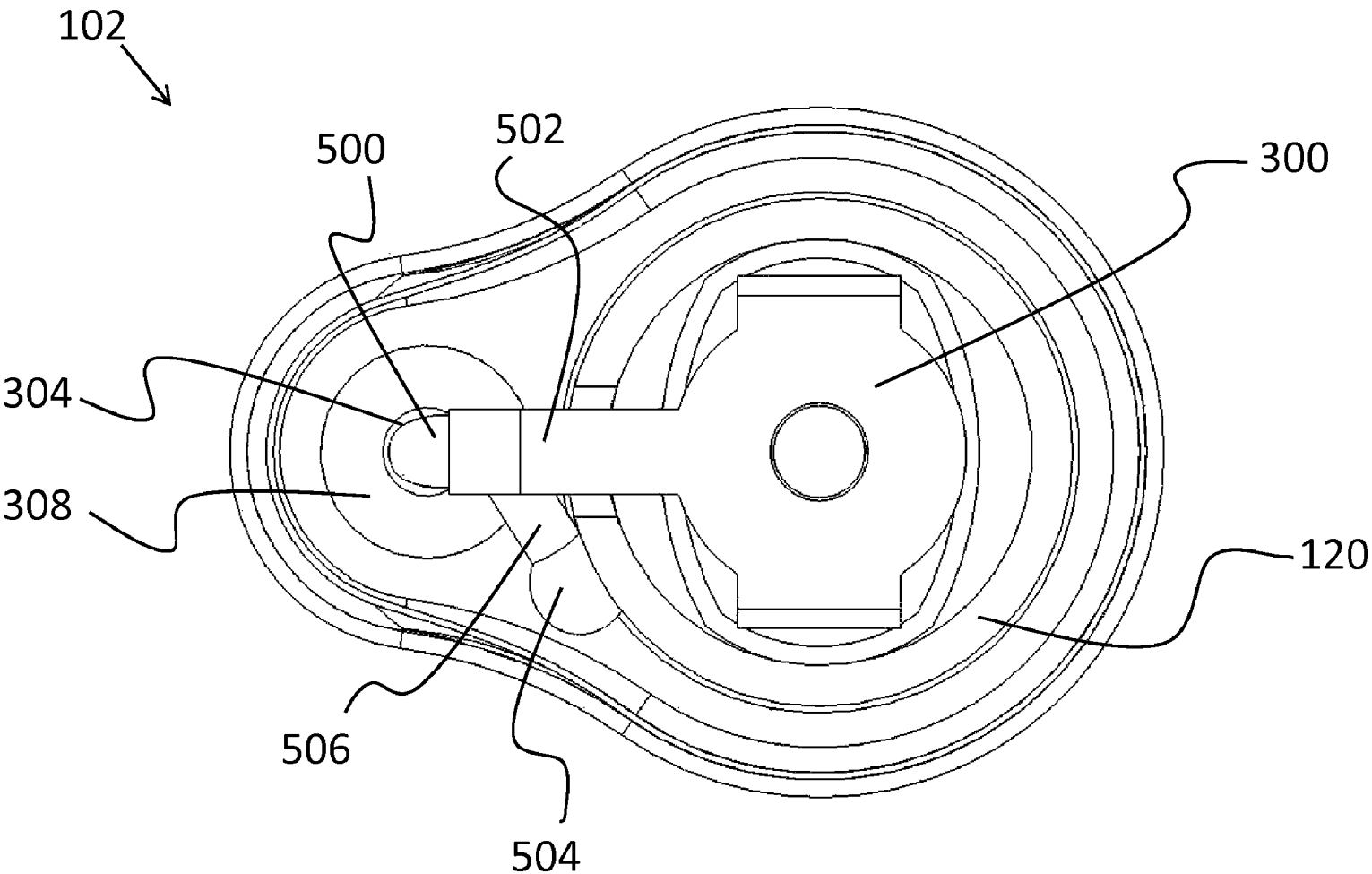
FIG. 5 is a top, cross-sectional view illustration of the plug member.

FIG. 5 depicts a top, cross-sectional view of a plug member (e.g., first plug member 102). As shown, the core conductor 304 is electrically connected with the female signal contact 300 using any suitably conductive connection. As a non-limiting example, a signal weld 500 and signal metallic bridge 502 links the two components. Alternatively, the shield conductor 308 is depicted as being electrically connected with the female shield contact 120 using a conductive connection, a non-limiting example of which includes a shield weld 504 and a shield metallic bridge 506.

Figure 6:
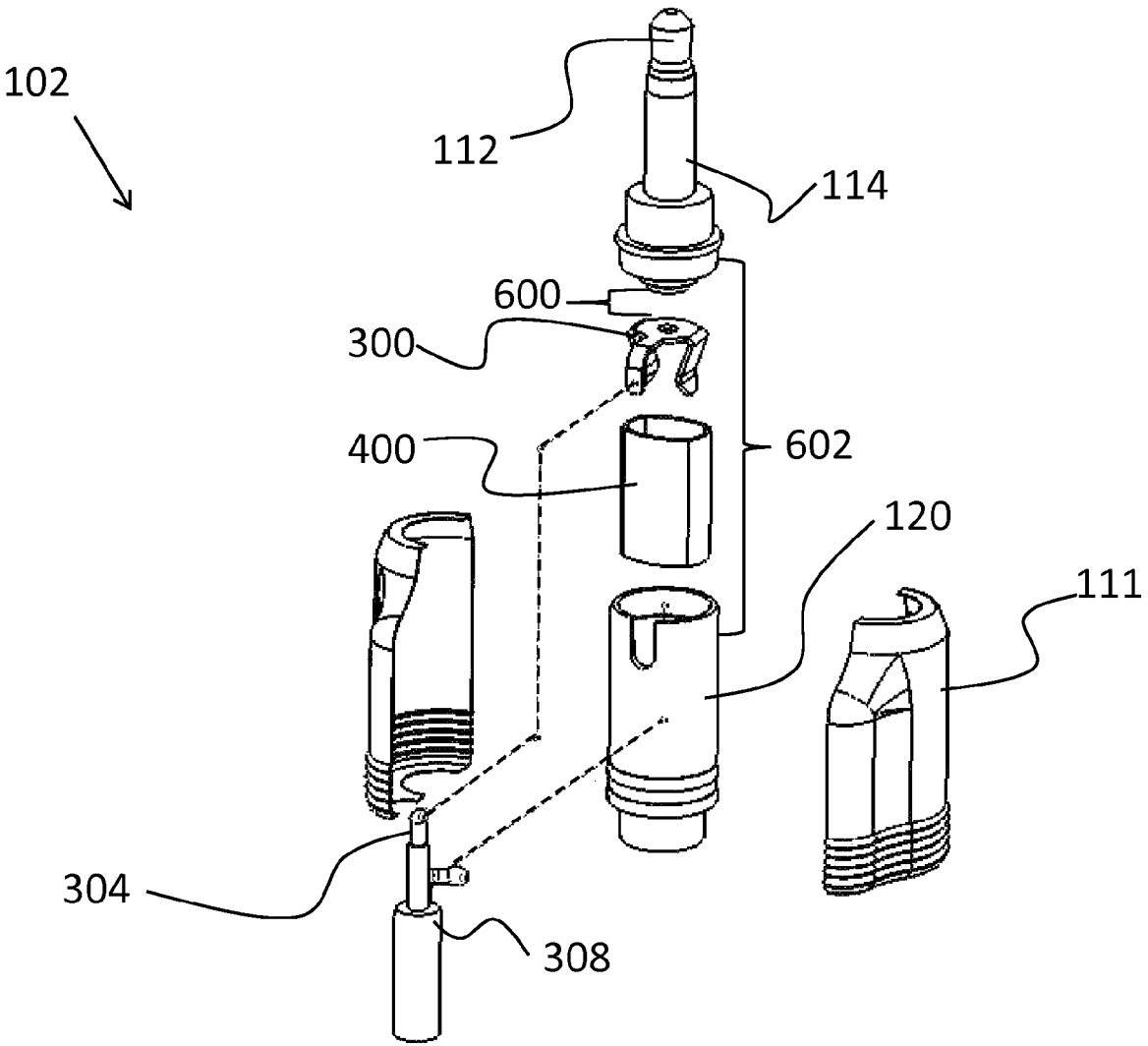
FIG. 6 is an exploded-view illustration of the plug member, illustrating contacts according to the present invention.

For further understanding, FIG. 6 depicts an exploded-view of a plug member (e.g., first plug member 102). As shown, the core conductor 304 is to be electrically connected with a signal contact (e.g., the female signal contact 300), while the shield conductor 308 is to be electrically connected with a shield contact (e.g., the female shield contact 120). Also shown is the female end barrier 400 that electrically isolates the female signal contact 300 from the female shield contact 120. The barrier 400 is any suitable mechanism or device for isolating said contacts, a non-limiting example of which includes a plastic sheath.

As the components come together and are encased within the housing 111, the male signal contact 112 becomes electrically connected with the female signal contact 300 at a signal connection 600. Additionally, the female shield contact 120 becomes electrically connected with the male shield contact 114 at shield connection 602. As can be understood by one skilled in the art, the connections as depicted in FIG. 6 are but one non-limiting example as there are multiple techniques for connecting the signal and shield contacts.

Figure 7:
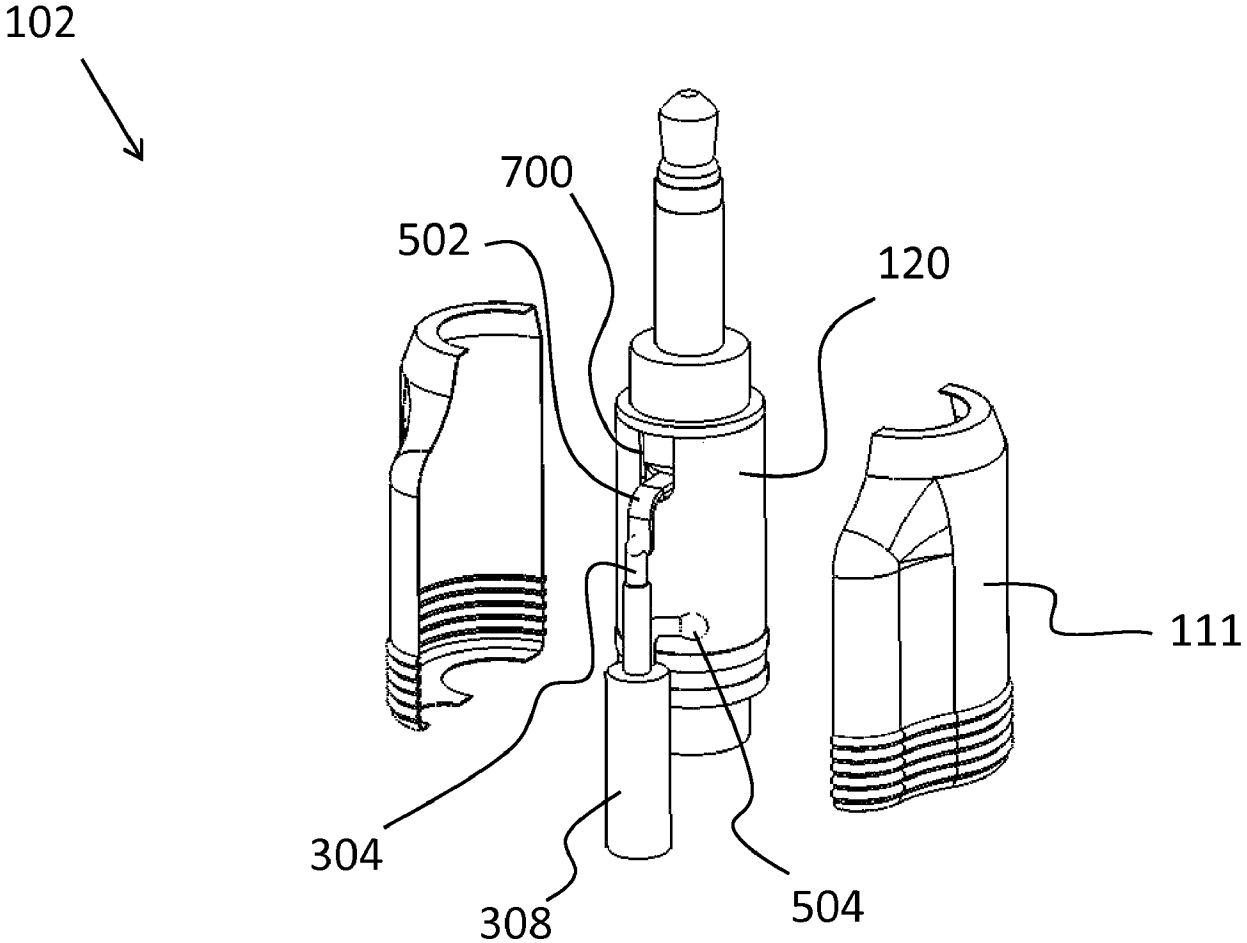
FIG. 7 is a perspective-view illustration of the plug member, depicting the contacts as assembled.

FIG. 7 is an illustration of a plug member (e.g., first plug member 102), depicting the contacts as assembled. As shown, the signal metallic bridge 502 that links the core conductor 304 with the female signal contact passes through a gap 700 within the female shield contact 120 to prevent contact therebetween. Also depicted is the shield weld 504 that electrically connects the shield conductor 308 with the female shield contact 120.

Again and as noted above, the various techniques for connecting the contacts (e.g., welds, gaps, etc.) are non-limiting examples as the invention is not intended to be limited thereto. Instead, the present invention is to be afforded the widest scope possible that is consistent with a device that includes a plug member with a male and female end, where each end has a signal contact that is electrically isolated from a shield contact (with the signal contacts being electrically connected with one another and the shield contacts being electrically connected with one another).

(3) Summary

In summary, the present invention is a stack able patch cable (i.e., Stack Able Audio Cable (SAAC)) for splitting an electrical signal. The SAAC allows a user to split and combine audio signals directly from the cables themselves, without the need to run multipliers, splitters and/or patch bays. The SAAC patch cable provides a convenient and easy approach to the task of splitting or combining signals, as well as improving electrical shielding and signal loss over standard signal splitters.

What is claimed is:

1. A stack able patch cable for splitting an electrical signal, comprising:

a. a first plug member, the first plug member having:

i. a male end, the male end having a male signal contact and a male shield contact electrically isolated from the male signal contact;

ii. a female end, the female end having a female signal contact and a female shield contact electrically isolated from the female signal contact, where the female signal contact is electrically connected with the male signal contact and where the female shield contact is electrically connected with the male shield contact, and wherein the female end is configured to receive a male end of a plug to electrically connect the corresponding contacts;

b. a cable having a first end and a second end, wherein the first end of the cable is connected with and extends from the first plug member, the cable having:

i. a relatively flexible, elongate core conductor disposed within the cable, the core conductor being electrically connected with both the male and female signal contacts;

ii. a first sleeve of an insulating material positioned about the core conductor;

iii. a relatively flexible shield conductor disposed outwardly of the first sleeve, the shield conductor being electrically connected with both the male and female shield contacts;

iv. a second sleeve of an insulating material positioned about the shield conductor;

c. a second plug member, the second plug member connected with the second end of the cable and having:

i. a male end, the male end having a male signal contact and a male shield contact electrically isolated from the male signal contact; and ii. a female end, the female end having a female signal contact and a female shield contact electrically isolated from the female signal contact, where the female signal contact is electrically connected with the male signal contact and where the female shield contact is electrically connected with the male shield contact, and wherein the female end is configured to receive a male end of a plug to electrically connect the corresponding contacts.

2. The stack able patch cable as set forth in claim 1, wherein the shield conductor is formed of a metallic braid that is braided around the first sleeve of insulating material.

3. The stack able patch cable as set forth in claim 2, wherein, within each plug member, a shared central axis runs through approximately a center of the female end and the corresponding male end, thereby allowing a plurality of plugs to be connected with one another in a stacked configuration with the plurality of plugs sharing the shared central axis.

4. The stack able patch cable as set forth in claim 3, wherein, within each plug member, the male end is formed as an elongated post, with the signal contact being formed as a central post and the shield contact being formed as a ring that partially surrounds the central post.

5. The stack able patch cable as set forth in claim 4, wherein, within each plug member, the female end is formed as a receptacle, with the female signal contact formed as a clip for mating with the elongated post, and wherein the female shield contact is formed as a metallic sleeve for mating with the ring.

6. The stack able patch cable as set forth in claim 1, wherein, within each plug member, the male end is formed as an elongated post, with the signal contact being formed as a central post and the shield contact being formed as a ring that partially surrounds the central post.

7. The stack able patch cable as set forth in claim 6, wherein, within each plug member, the female end is formed as a receptacle, with the female signal contact formed as a clip for mating with the elongated post, and wherein the female shield contact is formed as a metallic sleeve for mating with the ring.

8. The stack able patch cable as set forth in claim 1, wherein, within each plug member, a shared central axis runs through approximately a center of the female end and the corresponding male end, thereby allowing a plurality of plugs to be connected with one another in a stacked configuration with the plurality of plugs sharing the shared central axis.

9. A method for forming a stack able patch cable for splitting an electrical signal, comprising acts of:

a. forming a first plug member, the first plug member having:
   i. a male end, the male end having a male signal contact and a male shield contact electrically isolated from the male signal contact;
   ii, a female end, the female end having a female signal contact and a female shield contact electrically isolated from the female signal contact, where the female signal contact is electrically connected with the male signal contact and where the female shield contact is electrically connected with the male shield contact, and wherein the female end is configured to receive a male end of a plug to electrically connect the corresponding contacts;

b. connecting a cable with the first plug member, the cable having a first end and a second end, wherein the first end of the cable is connected with and extends from the first plug member, the cable having:
   i. a relatively flexible, elongate core conductor disposed within the cable, the core conductor being electrically connected with both the male and female signal contacts;
   ii. a first sleeve of an insulating material positioned about the core conductor;
   iii. a relatively flexible shield conductor disposed outwardly of the first sleeve, the shield conductor being electrically connected with both the male and female shield contacts;
   iv. a second sleeve of an insulating material positioned about the shield conductor;

c. forming a second plug member, the second plug member being formed to include:
   i. a male end, the male end having a male signal contact and a male shield contact electrically isolated from the male signal contact;
   ii. a female end, the female end having a female signal contact and a female shield contact electrically isolated from the female signal contact, where the female signal contact is electrically connected with the male signal contact and where the female shield contact is electrically connected with the male shield contact, and wherein the female end is configured to receive a male end of a plug to electrically connect the corresponding contacts; and d. connecting the second end of the cable with the second plug member.

10. The method as set forth in claim 9, wherein when forming each plug member, each plug member is formed such that a shared central axis runs through approximately a center of the female end and the corresponding male end, thereby allowing a plurality of plugs to be connected with one another in a stacked configuration with the plurality of plugs sharing the shared central axis.

11. The method as set forth in claim 10, wherein when forming each plug member, each plug member is formed such that the male end is formed as an elongated post, with the signal contact being formed as a central post and the shield contact being formed as a ring that partially surrounds the central post.

12. The method as set forth in claim 11, wherein when forming each plug member, each plug member is formed such that the female end is formed as a receptacle, with the female signal contact formed as a clip for mating with the elongated post, and wherein the female shield contact is formed as a metallic sleeve for mating with the ring.

13. The method as set forth in claim 9, wherein when forming each plug member, each plug member is formed such that the male end is formed as an elongated post, with the signal contact being formed as a central post and the shield contact being formed as a ring that partially surrounds the central post.

14. The method as set forth in claim 13, wherein when forming each plug member, each plug member is formed such that the female end is formed as a receptacle, with the female signal contact formed as a clip for mating with the elongated post, and wherein the female shield contact is formed as a metallic sleeve for mating with the ring.

* * * * *